US005783345A

United States Patent [19]

Yoshino et al.

[11] Patent Number: 5,783,345

[45] Date of Patent: Jul. 21, 1998

[54] IMAGE FORMING METHOD

[75] Inventors: Susumu Yoshino; Suk Kim; Takashi Imai; Kazuhiko Yanagida; Koichi Takashima, all of Minami-ashigara, Japan

[73] Assignee: Fuji Xerox Co., Ltd., Tokyo, Japan

[21] Appl. No.: 755,661

[22] Filed: Nov. 25, 1996

[30] Foreign Application Priority Data

Nov. 30, 1995 [JP] Japan ..... 7-311983

[51] Int. Cl.[6] ..... G03G 13/08

[52] U.S. Cl. ..... 430/102; 430/120

[58] Field of Search ..... 430/102, 110, 430/122, 120

[56] References Cited

U.S. PATENT DOCUMENTS 5,604,071 2/1997 Okado et al. ..... 430/110

5,614,344 3/1997 Kawakami et al. ..... 430/110

5,635,326 6/1997 Kanbayashi et al. ..... 430/110

FOREIGN PATENT DOCUMENTS

B2-1-27421 5/1989 Japan .

*Primary Examiner*—John Goodrow

*Attorney, Agent, or Firm*—Oliff & Berridge, PLC

[57] ABSTRACT

An image forming method wherein a developer layer formed by a layer forming material and supported on a developer supporting body is used to develop an electrostatic latent image on an electrostatic latent image supporting body, thereby forming an image. In the method, the direction of rotation of the developer supporting body is the same as that of the electrostatic latent image supporting body, the ratio of peripheral speed of the developer supporting body to the electrostatic latent image supporting body ranges from 0.7 to 1.8, the developer is composed of a carrier and a toner, and the toner contains a conductive inorganic fine powder. The method is useful for making an amount of static electrification of the toner suitable and stabilizing the same.

21 Claims, 1 Drawing Sheet

IMAGE FORMING METHOD

BACKGROUND OF THE INVENTION

1. Field of the Invention

The present invention relates to an image forming method, and more particularly to an image forming method wherein electrostatic latent images formed on an electrostatic latent image supporting body are developed by employing a developer supported on a developer supporting body.

2. Description of Related Art

In general, Carlson method has been conducted heretofore in case of forming images in copiers, laser beam printers and the like. In a conventional image forming method, an electrostatic latent image formed on a photosensitive material by an optical means is developed in a developing step, then, transferred on a recording medium such as recording papers in a transferring step, and thereafter, fixed on the recording medium by means of heat and pressure in general. Furthermore, since the above described photosensitive material is employed repeatedly, a cleaning means is mounted for removing remaining toner on the photosensitive material after the transferring step is completed.

A developing process applied for developing electrostatic latent images, when attention is focused on the developer, may be classified into a single-component development process wherein only a toner is used and a dual-component development process wherein a toner and a carrier are used. Concerning a dual-component developer in the dual-component development process, the toner and the carrier are agitated to frictionally charge the toner, so that an amount of triboelectrification of the toner can be controlled to a substantial degree by suitably selecting characteristics of the carrier and the agitating condition. Accordingly, the dual-component development process exhibits high reliability in the quality of image so that this process is superior.

Furthermore, the development process has been known as a magnetic brush development process, a cascade process and the like processes in view of a phenomenon utilized for development. Among them, the magnetic brush development process is preferably employed. The magnetic brush development process is the one wherein a developer containing toners is transported to a developing region by means of magnetic force on a developer supporting roll and then the toners are stuck onto an electrostatic latent image thereby effecting the development.

Equipment for the development is principally composed of the above described developer supporting roll, a layer restricting member for restricting a thickness of a developer layer on the roll to control an amount of the developer transported to a developing region, and an auger for agitating the developer. The developer used in such developing equipment as described above, and further a toner which is suitably added are agitated by the auger to conduct triboelectrification required for developing an electrostatic latent image.

As a result of a minute investigation by the present inventors, it has been found that the triboelectrification of a toner is made also at the side of upper stream of a layer restricting member (pre-nip section), as well as on a developer supporting roll, in which the toner has passed through a spacing defined between the layer restricting member and the developer supporting roll in developing equipment as described hereinafter.

To the pre-nip section is transported a developer an amount of which is at least larger than that of the developer passing through a nip section by means of a developer supporting roll, and the developer is divided into a developer fraction which can pass through the nip section and another developer fraction which cannot pass through the nip section. The developer fraction which cannot pass through the nip section remains for a while as a "bank" in the pre-nip section. During exhibiting the behavior of the developer as described above, the developer is agitated and forced by pressure due to another developer which is freshly transported to the pre-nip section. Thus, triboelectrification of a toner is made herein because of these phenomena as described above.

On the other hand, the developer which passed through the nip section forms a magnetic brush made of the standing developer in a brush-form by means of magnetic force, the magnetic brush thus formed is allowed to be slidably in contact with the surface of a latent image carrier to stick the toner to the electrostatic latent image thereby effecting development. In the part of the "slidable contact", triboelectrification of the toner is established.

However, since the "triboelectrification" is effected with accompanying contacts and collisions between a toner and a carrier due to physically external force, both the toner and the carrier are inevitably damaged. Namely, there cause embedding of an external additive added and dispersed to the toner surface into the toner, falling off of toner ingredients and the like. In a carrier, the surface thereof is contaminated with toner components including the external additive. In the case where the carrier is a resin-coated carrier, there cause wear and tear, breakage and the like of carrier coating components. When these disadvantageous accidents happen, initial characteristic properties of a developer comes to be not demonstrated because of repeated use, resulting in background fog, contamination in the equipment, variations in density of image.

SUMMARY OF THE INVENTION

In order to maintain a stable quality of a developer by even employing the same repeatedly, contacts and collisions between a toner and a carrier must be reduced so that they are not damaged as much as possible.

However, when such a development process as described hereinbefore is imagined, it is presumed that an appropriate static electrification is not applied to a toner.

Thus, it is concluded that an idea for accompanying no mechanical damage upon a toner and a carrier is indispensably required together with another idea for preparing a toner or a carrier which can get promptly an appropriate amount of static electrification for a developing function even if there occurs only a weak contact or collision of them.

The present invention has been made based on such a study as described above. Accordingly, an object of the present invention is to provide an image forming method wherein a developer is damaged slightly, and an amount of static electrification of a toner is suitable and stable in a repeated use of a copier.

The above described object is achieved by the present invention which will be explained hereinafter.

Namely, the present invention relates to an image forming method wherein a developer layer formed by a layer forming material and supported on a developer supporting body is used to develop an electrostatic latent image on an electrostatic latent image supporting body, the direction of rotation of the developer supporting body being the same as that of the electrostatic latent image supporting body, the ratio of peripheral speed of the developer supporting body to the electrostatic latent image supporting body ranging from 0.7 to 1.8, the developer being composed of a carrier and a toner, and the toner containing a conductive inorganic fine powder.

In the present invention, a ratio of peripheral speeds of the developer supporting body to the electrostatic latent image supporting body is within a range of from 0.7 to 1.8. Owing mainly to this, the developer hardly receives mechanical pressure, so that contacts and collisions between the toner and the carrier decrease. As a result they are hardly damaged.

Furthermore, mainly since the toner contains a conductive inorganic fine powder, suitableness and stabilization in an amount of static electrification of the toner are intended.

The term "layer forming material" referred to in the present invention means any material for forming a developer layer having a thickness suitable for development on the developer supporting body (for example, a drum). Accordingly, the term represents a concept including the aforementioned layer restricting material.

PREFERRED EMBODIMENTS OF THE INVENTION

Figure 1:
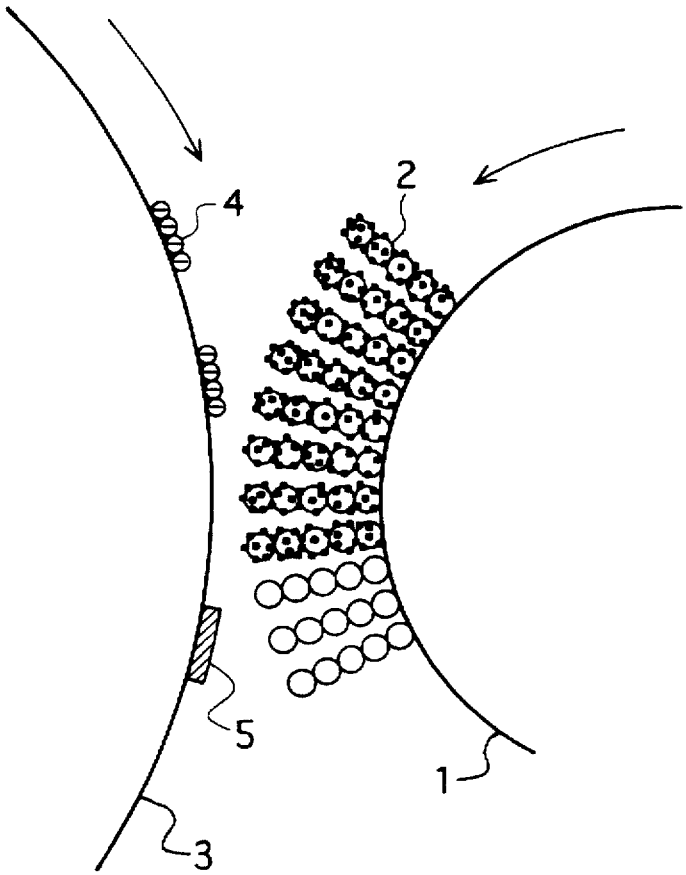
FIG. 1 is a schematic diagram showing a process of the image forming method according to the present invention.

The present invention will be described in more detail hereinafter in accordance with the embodiments thereof.

In the image forming method according to the present invention, a developer layer 2, in a magnetic brush manner, which is formed by a layer forming material and supported on a developer supporting body 1 is utilized to develop an electrostatic latent image 4 on an electrostatic latent image supporting body 3, thereby forming an image 5. In this case, directions of rotation of the developer supporting body and the electrostatic latent image supporting body are the same with each other, and in this situation, a higher image quality is obtained than that in the case where the directions of their rotation are opposite to each other.

In the present invention, the ratio of peripheral speed of the developer supporting body to the electrostatic latent image supporting body is within a range of from 0.7 to 1.8. When the ratio of the peripheral speed is less than 0.7, an amount of a toner to be transported decreases, so that a developing concentration will decrease, while when the ratio of the peripheral speed exceeds 1.7, mechanical pressure which may cause excessive collisions of the toner and the carrier and damage thereof is easily applied to the developer. In addition, an amount of the toner to be transported increases, so that fog is easily produced on the contrary. The above described ratio of the peripheral speed is preferably within a range of from 1.0 to 1.6.

In the present invention, when increase in an amount of the toner to be transported is desired, it is preferred that AC bias of usually from 1 to 4 kv, and preferably from 1.4 to 2.5 kv is applied to a developing region in addition to DC bias. In this case, a frequency is used within a range of from 1 to 10 kHz.

The developer used in the present invention is a dual-component developer composed of a carrier and a toner. The toner contains a conductive inorganic fine powder. The function thereof is as follows.

In the case where the ratio of peripheral speed of a developer supporting roll to a photosensitive material is within a range of from 0.7 to 1.8, the mechanical force as well as chances of contacts/electric charge-exchanges between a toner and a carrier decrease. Thus, charging speed of the toner which is supplemented into the developing equipment becomes slow. However, when a conductive inorganic fine powder is contained in the toner, exchange of electric charge is accelerated to return a charging amount of the toner to an appropriate electric charge level at an early stage, besides the amount of electric charge is stabilized. Accordingly, it is required that the conductive inorganic fine powder has such a degree of conductivity that the above-mentioned functions can be fulfilled. Namely, its specific resistance value is usually $10^{12}\Omega\cdot$cm or less, and preferably $10^{10}\Omega\cdot$cm or less.

An example of the conductive inorganic fine powder includes metals such as gold, silver, and copper; carbon black; oxides such as titanium oxide, and zinc oxide; and a material which is prepared by covering the surface of any of titanium oxide, zinc oxide, barium sulfate, aluminum borate, potassium titanate powder and the like with any of tin oxide, carbon black, and metals.

From the viewpoint of cost and color image forming adaptability (property for not making color cloudy and the like), titanium oxide, zinc oxide, or tin oxide is preferred.

This conductive inorganic fine powder can serve for the above described functions in both the cases in which the fine powder is allowed to contain inside the toner, and the fine powder is applied to the surface of the toner.

The conductive inorganic fine powder to be used has an average particle diameter of usually from 5 to 1000 nm, and preferably from 5 to 400 nm. When the average particle diameter exceeds 1000 nm, escaping the fine powder from the toner occurs easily, resulting in contamination of the carrier surface, and occurrence of contamination in the equipment, besides contamination and flaws on the surface of the photosensitive material. When the average particle diameter is less than 5 nm, cohesiveness is strong so that uniform dispersion of the fine powder becomes difficult, whereby exchangeability of electric charge decreases.

If necessary, a surface treatment may be applied to the conductive inorganic fine powder, with taking its dispersibility and adhesion to the toner into consideration, and for the sake of controlling more precisely properties of the above described exchange of electric charge.

In the case where the conductive inorganic fine powder is a material such as an oxide and the surface thereof can contain a hydroxyl group, a coupling agent which reacts with the hydroxyl group may be preferably used for the surface treatment.

As the coupling agent, for example, silane coupling agents, titanium-base coupling agents, aluminum-base coupling agents, and zirconium-base coupling agents may be used, but preferable is a silane coupling agent having any one of the following general formulae:

$$R_{4-x}Si(NCO)_x$$

$$R_{4-x}Si(OR^1)_x$$

$$R_{4-x}SiCl_x$$

wherein x is an integer of from 1 to 3, R is an alkyl group or a perfluoroalkyl group containing 1 to 16 carbon atoms, and $R^1$ is an alkyl group containing 1 to 3 carbon atoms (a methyl, ethyl or propyl group).

A specific example of the coupling agents includes $(CH_3)_2Si(NCO)_2$, $CH_3Si(NCO)_3$, $C_{10}H_{21}Si(OCH_3)_3$, or $CF_3Si$ $(OCH)_3$. Silane compounds wherein x=3 are preferred in view of improvement in dispersibility.

Furthermore, silicone oil may also be preferably used for surface treatment of a variety of conductive inorganic fine powders. An example of the silicone oil includes modified silicone oils in addition to dimethyl, methylphenyl, and methyl hydrogen silicone oils.

In the surface treatment described above, these coupling agents or silicone oils may be used singly or in combination thereof. In this case, an amount of coupling agent(s) and/or silicone oil(s) to be used for the surface treatment is from 2 to 50 parts by weight, and preferably from 5 to 30 parts by weight with respect to 100 parts by weight of the conductive inorganic fine powder.

Concerning the toner used in the present invention, the above described conductive inorganic fine powder is added to 100 parts by weight of the toner particles, in an amount of preferably from 2 to 20 parts by weight, and more preferably from 3 to 10 parts by weight in the case when the toner contains the conductive inorganic fine powder inside thereof. On the other hand, when the aforesaid conductive inorganic fine powder is added to the surface of the toner, an amount of the fine powder to be added is preferably from 0.5 to 4 parts by weight, and more preferably from 0.5 to 3 parts by weight.

Moreover, the above described conductive inorganic fine powder may be employed simultaneously with other additives such as silica, and alumina.

In the present invention, a toner particle to which is added the above described conductive inorganic fine powder is composed of, at least, a colorant and a binder resin, which may be selected from any types so far as they can be employed in the art.

Examples of the binder resin include homopolymers or copolymers prepared from styrenes such as styrene and chlorostyrene; monoolefins such as ethylene, propylene, and isoprene; vinyl esters such as vinyl acetate, vinyl propionate, vinyl benzoate, and vinyl acetate; α-methylene aliphatic monocarboxylic esters such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinyl ethers such as vinyl methyl ether, vinyl ethyl ether, and vinyl butyl ether; vinyl ketones such as vinyl methyl ketone, vinyl hexyl ketone, and vinyl isopropenyl ketone; and the like monomers. An example of particularly typical binder resins includes polystyrene, styrene-alkyl acrylate copolymers, styrene-alkyl methacrylate copolymers, styrene-acrylonitrile copolymers, styrene-butadiene copolymers, styrene-maleic anhydride copolymers, polyethylene, and polypropylene.

Furthermore, an example of the binder resins includes polyester, polyurethane, epoxy resin, silicone resin, polyamide, modified rosin, paraffins, and waxes. Among them, polyester is particularly effective as the binder resin. More specifically, a linear polyester resin of polycondensate prepared from bisphenol A and a polyhydric aromatic carboxylic acid as the major monomer components can be preferably employed.

The above described polyesters can be manufactured by the reaction of a polyhydric alcohol and a polybasic carboxylic acid.

Examples of a polyhydric alcohol being a component of polyester include, for example, diols such as ethylene glycol, diethylene glycol, triethylene glycol, 1,2-propylene glycol, 1,3-propylene glycol, 1,4-butane diol, and neopentyl glycol; bisphenol A alkylene oxide adducts such as bisphenol A, hydrogenated bisphenol A, polyoxyethylated bisphenol A, and polyoxypropylated bisphenol A; and other divalent alcohols. Trimethylol propane, 1,3,5-trihydroxymethyl benzene, and other polyhydric alcohols may also be employed.

Examples of a polybasic carboxylic acid being a component of polyester include, for example, maleic acid, fumaric acid, mesaconic acid, citraconic acid, itaconic acid, glutaconic acid, phthalic acid, isophthalic acid, cyclohexane dicarboxylic acid, succinic acid, adipic acid, sebacic acid, malonic acid and alkylsuccinic acids; the acid anhydrides thereof; alkyl esters thereof; and other dibasic carboxylic acids.

In addition to these carboxylic acids, a polyhydric alcohol having tri- or more valency and/or a polybasic carboxylic acid having tri- or more basicity may be added in order to make the polymer non-linearlized to such a degree that no tetrahydrofuran insoluble matter is produced. An example of the polyhydric alcohol having tri- or more valency includes, for example, sorbitol, 1,2,3,6-hexanetetrol, 1,4-sorbitan, pentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethyl-benzene. An example of the polybasic carboxylic acid having tri- or more basicity includes, for example, 1,2,4-benzene tricarboxylic acid, 1,2,5-benzenetricarboxylic acid, 1,2,4-cyclohexanetricarboxylic acid, 2,5,7-naphthalene-tricarboxylic acid, and 1,2,4-butanetricarboxylic acid.

Furthermore, a resin having a softening point of 90° to 150 ° C., a glass transition point of 50° to 70° C., a number-average molecular weight of 2,000 to 6,000, a weight-average molecular weight of 8,000 to 150,000, an acid value of 5 to 30, and a hydroxyl value of 5 to 40 is particularly preferably employed as a binder resin.

Typical examples of a colorant for toner particles include carbon black, nigrosine, aniline blue, chalcoyl blue, chrome yellow, ultramarine blue, du Pont oil red, quinoline yellow, methylene blue chloride, phthalocyanine blue, malachite green oxalate, lamp black, rose bengale, C.I. pigment red 48:1, C.I. pigment red 122, C.I. pigment red 57:1, C.I. pigment yellow 97, C.I. pigment yellow 12, C.I. pigment blue 15:1, and C.I. pigment blue 15:3.

Into these toner particles, known additives such as an electric charge controlling agent and a fixing assistant may be contained.

In the present invention, a toner particle having usually an average particle diameter of less than about 30 μm, and preferably 4 to 20 μm may be used.

As to the carrier to be employed in the present invention, there is no particular limitation relevant to a type of the carrier so far as it can be used in the art. Specifically, iron powder-base carriers, ferrite-base carriers, surface-covered ferrite carriers, magnetic powder dispersion type carriers and the like may be employed. Particularly, a carrier the surface of which is covered with a resin is preferred from the viewpoints of electric charge affording ability and improvements in durability and the like.

In the toner employed in the present invention, addition of a variety of additives including a conductive inorganic fine powder to the inside of toner particles may be carried out by kneading processing. The kneading in this case may be effected by utilizing a known heating kneader. An example of such kneaders includes three-roll type, single-screw type, twin-screw type, and Banbury mixer type kneaders. Moreover, adhesion of the above described additives onto the surface of a toner particle can be conducted by the use of a known means, for example, a high-speed mixer. A specific example of the mixer includes a Henschel mixer, a V-shaped blender and the like. To obtain stronger adhesion, a hybridization system (manufactured by Nara Kikai Seisaku-sho), a mechanofusion system (manufactured by Hosokawa Micron Corp.), a cryptron system (manufactured by Kawasaki Heavy Industries, Ltd.) and the like may be adopted.

The toner to be used in the present invention may have either indeterminate forms or spherical form. To obtain a spherical toner, there is used a manner by means of mechanical impact force and hot air with the use of the hybridization system (manufactured by Nara Kikai Seisaku-sho), the mechanofusion system (manufactured by Hosokawa Micron Corp.), the cryptron system (manufactured by Kawasaki Heavy Industries, Ltd.) and the like systems.

EXAMPLES

The present invention will be described hereinafter in more detail in conjunction with examples.

Example 1

Additive a (Inorganic Finely Divided Powder)

1.0 g of $C_{10}H_{21}Si(OCH_3)_3$ was dissolved in a mixed solvent consisting of 95 parts of methanol and 5 parts of water, then 10 g of $TiO_2$-base inorganic fine powder (trade name: TTO-55 manufactured by Ishihara Sangyo Kaisha, Ltd.) were added thereto, and the admixture was subjected to ultrasonic dispersion to surface-treat the TTO-55 surface thereby forming alkyl groups on the surface thereof. The solvents including methanol were vaporized off from the fine powder by means of an evaporator, then dried, heat-treated in a dryer which was set at 120° C., and ground in an automatic mortar to obtain an additive a. The specific resistance and the average particle diameter thereof were $1.0\times10^9\Omega\cdot$cm, and 20 nm, respectively.

Production of Toner Particle

Toner A

| | |
|---|---|
| linear polyester resin (a linear polyester prepared from terephthalic acid/bisphenol A ethylene oxide adduct/cyclohexane di-methanol; Tg = 62° C., Mn = 4,000, Mw = 35,000, acid value = 12, hydroxyl value = 25) | 100% by weight |
| Magenta pigment (C.I. pigment Red 57) | 3% by weight |

The resulting mixture was kneaded with an extruder, ground by means of a jet mill, and then dispersed by an air classifying device to obtain a Magenta toner particle of d50=8 μm.

Production of Toner Composition

Toner Composition 1

To 100 parts by weight of the toner A were added 1.0 part by weight of silica (trade name: R972 manufactured by Nippon Aerosil Co.) and 1.0 part by weight of $SnO_2$-base conductive inorganic fine powder (trade name: S-1 manufactured by Mitsubishi Material Co., specific resistance: $1.0\times10^7\Omega\cdot$cm, and average particle diameter: 20 nm), and the resulting mixture was admixed by a high speed mixer to obtain a toner composition 1.

Toner Composition 2

To 100 parts by weight of the toner A were added 1.0 part by weight of silica (trade name: R812 manufactured by Nippon Aerosil Co.) and 0.8 part by weight of $TiO_2$-base conductive inorganic fine powder (trade name: MT500B manufactured by Tayca Corp., specific resistance: $1.0\times10^9\Omega\cdot$cm, and average particle diameter: 35 nm), and the resulting mixture was admixed by a high speed mixer to obtain a toner composition 2.

Toner Composition 3

To 100 parts by weight of the toner A were added 1.0 part by weight of silica (trade name: R812 manufactured by Nippon Aerosil Co.) and 0.6 part by weight of $TiO_2$-base conductive inorganic fine powder (trade name: TTO-55 manufactured by Ishihara Sangyo Kaisha Ltd., specific resistance: $1.0\times10^9\Omega\cdot$cm, and average particle diameter: 20 nm), and the resulting mixture was admixed by a high speed mixer to obtain a toner composition 3.

Toner Composition 4

To 100 parts by weight of the toner A were added 1.0 part by weight of silica (trade name: R812 manufactured by Nippon Aerosil Co.) and 0.6 part by weight of $BaSO_4$-base conductive inorganic fine powder coated with $SnO_2$ (trade name: Passtoran-type IV manufactured by Mitsui Mining & Smelting Co.,Ltd., specific resistance: $1.0\times10^5\Omega\cdot$cm, and average particle diameter:200 nm), and the resulting mixture was admixed by a high speed mixer to obtain a toner composition 4.

Toner Composition 5

To 100 parts by weight of the toner A were added 1.0 part by weight of silica (trade name: R972 manufactured by Nippon Aerosil Co.) and 0.8 part by weight of ZnO-base conductive inorganic fine powder (trade name: ZnO-100 manufactured by Sumitomo Cement Co. Ltd., specific resistance: $1.0\times10^8\Omega\cdot$cm, and average particle diameter: 9 nm), and the resulting mixture was admixed by a high speed mixer to obtain a toner composition 5.

Toner Composition 6

To 100 parts by weight of the toner A were added 0.5 part by weight of silica (trade name: R972 manufactured by Nippon Aerosil Co.) and 1.8 parts by weight of the additive a, and the resulting mixture was admixed by a high speed mixer to obtain a toner composition 6.

Preparation of Developer

The above described toner compositions 1 to 6 and a carrier made of ferrite having a particle diameter of about 50 μm and covered with a methyl methacryrate-styrene copolymer were used. Seven parts by weight of each of the toner compositions were added to 100 parts by weight of the carrier, and the resulting mixture was admixed by means of a tumbler shaker mixer to obtain each developer for evaluation.

A copying test was conducted with the use of these developers and an electrographic copier (a modified machine of A-Color 630 manufactured by Fuji Xerox Co., Ltd. wherein a ratio of peripheral speed of a developer supporting roll to a photosensitive material is 0.8, an AC bias voltage is 1.5 kV, and a frequency is 6 kHz). Namely, the copying test for 10,000 papers was carried out by employing these toner compositions under an environment of an intermediate temperature and an intermediate humidity (22° C., 55%RH). As a result, stable images were generally obtained without accompanying variations in image concentration and background contamination or streaks. An amount of electric charge at the initial stage of the test, an amount of electric charge after completing the copying test for 100 papers, and an amount of electric charge after completing the copying test for 10,000 papers were measured, respectively.

A further copying test was conducted with the use of these developers and an electrographic copier (another modified machine of A-Color 630 manufactured by Fuji Xerox Co., Ltd. wherein a ratio of peripheral speed of a developer supporting roll to a photosensitive material was 1.4, an AC bias voltage was 1.5 kV, and a frequency was 6 kHz). Namely, the copying test for 10,000 papers was carried out by employing these toner compositions under an environment of an intermediate temperature and an intermediate humidity (22° C., 55%RH). As a result, stable images were generally obtained without accompanying variations in image concentration and background contamination or streaks. An amount of electric charge at the initial stage of the test, an amount of electric charge after completing the copying test for 100 papers, and an amount of electric charge after completing the copying test for 10,000 papers were measured, respectively.

It is to be noted that the amount of electric charge indicated herein is a value derived from image analysis by means of CSG (charge spectrography).

The results obtained are shown in the Tables 1 and 2, respectively, as described below.

In the case where the toner compositions according to the present invention were used, amounts of electric charge were scarcely changed at ratios of peripheral speed of 0.8 and 1.4.

Comparative Example 1

Production of Toner Composition

Toner Composition 7

A toner composition 7 was obtained by the same process as that for the toner composition 1 except for excluding a $SnO_2$-base conductive inorganic fine powder S-1.

Toner Composition 8

A toner composition 8 was obtained by the same process as that for the toner composition 6 except for excluding the additive a.

These toner compositions and the same carrier as that of Example 1 were employed and evaluation was made in accordance with the same manner as that of Example 1. The results are shown in the Tables 1 and 2.

When a conductive inorganic fine powder was not added externally, a charging speed of toner added to the developing machine was slow, and background fog was remarkable (from the amount of electric charge after completing the copying test of 100 papers onward).

Example 2

| | |
|---|---|
| Styrene-n-butyl methacrylate (70/30) copolymer (Mn = about 7,000, Mw = about 40,000) | 97% by weight |
| Cyan pigment (β-type phthalocyanine: C.I. pigment blue 15:3) | 3% by weight |

The above described mixture was molten and kneaded, then pulverized, and classified to obtain a cyan toner particle having d50=8 μm.

To 100 parts by weight of the cyan toner particles were added 0.9 part by weight of the additive a used in Example 1 and 0.9 part by weight of silica (trade name: R972 manufactured by Nippon Aerosil Co.), and the resulting mixture was admixed by a high speed mixer to obtain a cyan composition. Six parts by weight of the cyan composition were admixed with 100 parts by weight of a carrier prepared by covering ferrite having a particle diameter of about 50 μm with a methyl methacrylate-styrene copolymer to obtain a developer.

A copying test was conducted with the use of this developer by means of an electrographic copier (a modified machine of A-Color 630 manufactured by Fuji Xerox Co., Ltd. wherein a ratio of peripheral speed of a developer supporting roll to a photosensitive material was 1, an AC bias voltage was 1.5 kV, and a frequency was 6 kHz). The copying test gave no background fog, and images having good quality and a high density from the early stage. Furthermore, continuous copying on 8,000 papers was carried out. As a result, changes in the image quality were scarcely observed.

Examples 3 and 4

A magenta toner particle and an yellow toner particle each having an average particle diameter of 8 μm were obtained by substituting 3 parts by weight of a magenta pigment (brilliant carmine 6BC: C.I. pigment red 57) and 3 parts by weight of an yellow pigment (disazo yellow: C.I. pigment yellow 12), respectively, for 3 parts by weight of the cyan pigment of Example 2 in accordance with the same manner as that of Example 2.

To 100 parts by weight of the aforesaid magenta toner particle and the aforesaid yellow toner particle, respectively, were added 1.0 parts by weight of the additive a and 1.1 parts by weight of silica (trade name: R972 manufactured by Nippon Aerosil Co.), both of which were employed in Example 1. Each of the resulting mixtures was admixed by a high speed mixer to obtain a magenta toner composition and an yellow toner composition, respectively.

A developer was prepared by the same manner as that of Example 2, and a copying test was conducted in accordance with the same manner as that of Example 2. No background fog was observed, and images of good quality were obtained at a high density from the early stage. Furthermore, continuous copying on 8,000 papers was carried out. As a result, changes in the image quality were scarcely observed.

TABLE 1

Ratio of Peripheral Speed: 0.8

| Toner Composition No. | Initial Amount of Electric Charge (μC/g) | Amount of Electric Charge After Copying on 100 Papers (μC/g) | Amount of Electric Charge After Copying on 10,000 Papers (μC/g) |
|---|---|---|---|
| 1 | −20.1 | −22.1 | −23.0 |
| 2 | −18.2 | −23.4 | −21.4 |
| 3 | −25.0 | −23.4 | −24.4 |
| 4 | −23.9 | −21.6 | −20.3 |
| 5 | −23.8 | −25.8 | −22.1 |
| 6 | −22.5 | −18.6 | −18.2 |
| 7 | −26.5 | −14.5 | — |
| 8 | −28.5 | −15.2 | — |

TABLE 2

Ratio of Peripheral Speed: 1.4

| Toner Composition No. | Initial Amount of Electric Charge (μC/g) | Amount of Electric Charge After Copying on 100 Papers (μC/g) | Amount of Electric Charge After Copying on 10,000 Papers (μC/g) |
|---|---|---|---|
| 1 | −23.1 | −20.1 | −23.6 |
| 2 | −19.2 | −24.4 | −23.9 |
| 3 | −23.7 | −24.0 | −22.7 |
| 4 | −19.8 | −22.6 | −20.1 |
| 5 | −25.1 | −23.8 | −24.9 |
| 6 | −20.9 | −19.6 | −21.2 |
| 7 | −27.5 | −15.5 | — |
| 8 | −26.1 | −13.2 | — |

Comparative Example 2

A copying test was conducted with the use of developers prepared from toner compositions 1 to 8, respectively, and an electrographic copier (a modified machine of A-Color 630 manufactured by Fuji Xerox Co., Ltd. wherein a ratio of peripheral speed of a developer supporting roll to a photosensitive material was 0.5). Namely, the copying test for 10,000 papers was carried out by employing these toner compositions under an environment of an intermediate temperature and an intermediate humidity (22° C., 55%RH). As a result, while amount of electric charge were stable, image densities were generally low and images of poor quality were obtained. Furthermore, an amount of electric charge at the initial stage of the test, an amount of electric charge after completing the copying test for 100 papers, and an amount of electric charge after completing the copying test for 10,000 papers were measured, respectively.

The results obtained are shown in the following Table 3.

A further copying test was conducted with the use of these developers prepared from the toner compositions 1 to 8, respectively, and an electrographic copier (another modified machine of A-Color 630 manufactured by Fuji Xerox Co., Ltd. wherein a ratio of peripheral speed of a developer supporting roll to a photosensitive material was 2.4). Namely, the copying test for 10,000 papers was carried out by employing these toner compositions under an environment of an intermediate temperature and an intermediate humidity (22° C., 55%RH). As a result, the amount of electric charge decreased gradually, and background contamination was observed, so that images of poor quality were obtained. An amount of electric charge at the initial stage of the test, an amount of electric charge after completing the copying test for 100 papers, and an amount of electric charge after completing the copying test for 10,000 papers were measured, respectively.

The results obtained are shown in the following Table 4.

TABLE 3

Ratio of Peripheral Speed: 0.5

| Toner Composition No. | Initial Amount of Electric Charge (μC/g) | Amount of Electric Charge After Copying on 100 Papers (μC/g) | Amount of Electric Charge After Copying on 10,000 Papers (μC/g) |
|---|---|---|---|
| 1 | −19.1 | −19.1 | −18.6 |
| 2 | −20.9 | −23.4 | −21.9 |
| 3 | −25.9 | −22.5 | −20.7 |
| 4 | −21.8 | −22.6 | −18.3 |
| 5 | −23.1 | −21.9 | −21.3 |
| 6 | −20.9 | −20.6 | −21.2 |
| 7 | −23.5 | −15.5 | — |
| 8 | −22.5 | −13.2 | — |

TABLE 4

Ratio of Peripheral Speed: 2.4

| Toner Composition No. | Initial Amount of Electric Charge (μC/g) | Amount of Electric Charge After Copying on 100 Papers (μC/g) | Amount of Electric Charge After Copying on 10,000 Papers (μC/g) |
|---|---|---|---|
| 1 | −23.1 | −20.1 | −16.6 |
| 2 | −19.2 | −24.4 | −15.9 |
| 3 | −23.7 | −24.0 | −13.9 |
| 4 | −19.8 | −22.6 | −16.1 |
| 5 | −25.1 | −23.8 | −15.9 |
| 6 | −20.9 | −19.6 | −14.7 |
| 7 | −27.5 | −23.5 | −15.1 |
| 8 | −26.1 | −24.3 | −13.2 |

According to the image forming method of the present invention, the ratio of peripheral speed of a developer supporting body to an electrostatic latent image supporting body is defined within a range of from 0.7 to 1.8. Thus, a mechanical pressure is hardly applied to the developer, so that chances of contacts and collisions between the toner and the carrier decrease, whereby they are difficult to be damaged.

Moreover, since a toner containing at least a conductive inorganic fine powder is used as a component of a dual-component developer, the charging speed of the toner particles is improved and the distributing range of electric charge becomes narrow. Thus, a stable amount of electric charge is maintained even in continuous use over a long time and a stable image quality can be obtained.

What is claimed is:

1. An image forming method, comprising:

forming a developer layer on a layer forming material supported on a rotating developer supporting body and developing an electrostatic latent image on a rotating electrostatic latent image supporting body with said developing layers wherein said electrostatic latent image supporting body is disposed in a position opposed to said developer supporting body, wherein a direction of rotation of said developer supporting body is the same as a direction of rotation of said electrostatic latent image supporting body and a ratio of peripheral speed of said developer supporting body to said electrostatic latent image supporting body ranges from 0.7 to 1.8, and wherein the developer layer comprises a carrier and a toner, and said toner comprises a conductive inorganic fine powder having an average particle diameter of from 5 to 1000 nm.

2. An image forming method as claimed in claim 1 wherein said carrier is a carrier coated with a resin.

3. An image forming method as claimed in claim 1 wherein a value of the specific resistance of said conductive inorganic fine powder is $10^{12}\Omega\cdot$cm or less.

4. An image forming method as claimed in claim 3 wherein a value of the specific resistance of said conductive inorganic fine powder is $10^{10}\Omega\cdot$cm or less.

5. An image forming method as claimed in claim 1 wherein AC bias is applied towards a developing region of said electrostatic latent image supporting body.

6. An image forming method as claimed in claim 5 wherein said AC bias is within a range of from 1 to 4 kV, and a frequency thereof is within a range of from 1 to 10 kHz.

7. An image forming method as claimed in claim 1 wherein said conductive inorganic fine powder contains titanium oxide, zinc oxide, or tin oxide.

8. An image forming method as claimed in claim 1 wherein said conductive inorganic fine powder is surface-treated with a treatment agent.

9. An image forming method as claimed in claim 1 wherein said treatment agent is selected from the group consisting of silane coupling agents, titanium coupling agents, aluminum coupling agents, and silicone oil.

10. An image forming method as claimed in claim 9 wherein said treatment agent is selected from the group consisting of silane coupling agents represented by the following general formulae:

$$R_{4-x}Si(NCO)_x$$

$$R_{4-x}Si(OR^1)_x$$

$$R_{4-x}SiCl_x$$

wherein x is an integer of from 1 to 3, R is an alkyl group or a perfluoroalkyl group containing 1 to 16 carbon atoms, and $R^1$ is an alkyl group containing 1 to 3 carbon atoms.

11. An image forming method as claimed in claim 9 wherein 2 to 50 parts by weight of the treatment agent is employed with respect to 100 parts by weight of said conductive inorganic fine powder.

12. An image forming method as claimed in claim 1 wherein said toner is a color toner.

13. An image forming method as claimed in claim 1 wherein said conductive inorganic fine powder is added at a ratio of from 0.5 to 20 parts by weight with respect to 100 parts by weight of said toner.

14. An image forming method as claimed in claim 1 wherein a linear polyester is contained as a binder resin for said toner.

15. An image forming method as claimed in claim 1 wherein a ratio of peripheral speed of said developer supporting body to said electrostatic latent image supporting body is within a range of from 1.0 to 1.6.

16. An image forming method including the steps of supporting a developer layer on a rotating body which supports a developer, and developing an electrostatic latent image on a rotatable photosensitive material disposed in a position opposed to the developer supporting body by means of said developer layer, the direction of rotation of said developer supporting body being the same as that of said photosensitive material, the ratio of peripheral speed of said developer supporting body to said photosensitive material ranging from 0.7 to 1.8, the developer being composed of a carrier and a toner, and said toner containing a conductive inorganic fine powder having an average particle diameter of from 5 to 1000 nm.

17. An image forming method as claimed in claim 16 wherein said carrier is a carrier coated with a resin.

18. An image forming method as claimed in claim 17 wherein a value of the specific resistance of said conductive inorganic fine powder is $10^{12}\Omega\cdot$cm or less.

19. An image forming method as claimed in claim 18 wherein AC bias is applied towards a developing region of said photosensitive material.

20. An image forming method as claimed in claim 9, wherein said silane coupling agents are selected from the group consisting of $R_{4-x}Si(NCO)_x$ and $R_{4-x}SiCl_x$, wherein x is an integer of from 1 to 3 and R is an alkyl group or perfluoroalkyl group containing 1 to 16 carbon atoms.

21. An image forming method as claimed in claim 9, wherein said silane coupling agent is $R_{4-x}Si(OR^1)_x$, wherein x is an integer of from 1 to 3, R is a perfluoroalkyl group containing 1 to 16 carbon atoms, and $R^1$ is an alkyl group containing 1 to 3 carbon atoms.

* * * * *